US005613631A

United States Patent [19]

Ziemek et al.

[11] Patent Number: 5,613,631

[45] Date of Patent: Mar. 25, 1997

[54] METHOD FOR PRODUCING A LENGTHWISE WELDED METAL TUBE

[75] Inventors: Gerhard Ziemek; Harry Staschewski, both of Langenhagen; Klaus Porcher, Lehrte, all of Germany

[73] Assignee: Alcatel Kabel AG & Co, Germany

[21] Appl. No.: 521,514

[22] Filed: Aug. 30, 1995

[30] Foreign Application Priority Data

Sep. 24, 1994 [DE] Germany ..... 44 34 134.2

[51] Int. Cl.[6] ..... B23K 31/02; H04B 9/00

[52] U.S. Cl. ..... 228/148; 228/17.5; 219/121.64

[58] Field of Search ..... 228/16, 17.5, 147, 228/148, 151; 219/121.13, 121.14, 121.63, 121.64

[56] References Cited

U.S. PATENT DOCUMENTS

| | | | |
|---|---|---|---|
| 4,759,487 | 7/1988 | Karlinski | 228/148 X |
| 4,839,496 | 6/1989 | Armier et al. | 219/121.63 |
| 4,995,549 | 2/1991 | Hellman, Sr. | 228/17.5 |
| 5,072,870 | 12/1991 | Ziemek | 228/148 X |
| 5,143,274 | 9/1992 | Laupretre et al. | 228/148 X |
| 5,210,391 | 5/1993 | Yoshie et al. | 219/121.63 |
| 5,318,215 | 6/1994 | Toya et al. | 228/148 |

FOREIGN PATENT DOCUMENTS

| | | |
|---|---|---|
| 2128115 | 6/1971 | Germany . |
| 2139233 | 8/1971 | Germany . |
| 3808728 | 3/1988 | Germany . |
| 3842865 | 12/1988 | Germany . |
| 3922816 | 7/1989 | Germany . |
| 4006167 | 2/1990 | Germany . |
| 4027512 | 8/1990 | Germany . |
| 4031825 | 8/1990 | Germany . |
| 4307156 | 3/1993 | Germany . |

*Primary Examiner*—Kenneth J. Ramsey

*Attorney, Agent, or Firm*—Ware, Fressola, Van Der Sluys & Adolphson

[57] ABSTRACT

In a method for producing a lengthwise welded metal tube with an outside diameter of 1 to 6 mm, whereby a metal band is shaped into a lengthwise slotted tube by a forming tool, and the lengthwise slot of the tube is welded by a laser welding installation, the tube to be welded passes immediately before and immediately after the welding point area through a guide that guides the surface of the tube to keep the edges of the band in contact with each other and keeps the welded seam stress-free. The jaws of a clamping tool grip the welded tube immediately downstream of the guide to keep it from twisting.

16 Claims, 2 Drawing Sheets

METHOD FOR PRODUCING A LENGTHWISE WELDED METAL TUBE

BACKGROUND OF THE INVENTION

1. Technical Field

The invention concerns a method for producing a lengthwise welded metal tube with an outside diameter of 1 to 6 mm, whereby a metal band is drawn from a storage reel and is shaped into a lengthwise slotted tube by a forming tool, and the lengthwise slot is welded by a laser welding installation.

2. Description of the Prior Art

The manufacture of metal tubes in the indicated range of diameters from a metal band, which is shaped into a slotted tube and whose lengthwise slot is welded by a laser, is known from U.S. Pat. No. 4,759,487. The metal band, e.g. a band of stainless steel, is gradually shaped into a lengthwise slotted tube by a first forming tool, which contains several pairs of shaping rollers. A second forming tool, which also contains several pairs of shaping rollers, transforms the tube with the lengthwise slot into a tube with abutting band edges. The shaping rollers of the second forming tool only touch the tube on the outside surface. A pair of rollers is provided downstream of the second forming tool and guides the slotted tube at a predetermined distance from the focal point of a laser welding installation. After the welding installation, the tube enters a cooling tube containing a large clearance, in which the welded seam is thoroughly cooled with argon. The welded metal tube then enters a drawing device which reduces its diameter. The puller which draws the metal band from the storage reel and pulls it through the shaping tools and the drawing device, is a motorized take-up reel around which the metal tube is wound 180°. The take-up reel has a V-groove around its periphery, into which the metal tube is pressed so that a sufficient pulling force is exerted. However, this can produce an oval deformation of the metal tube. The lateral orientation of the lengthwise slot with respect to the laser beam takes place through the top rollers of the second forming tool, which contain peripherally extending protrusions that dig into the slotted tube and guide the band edges.

In addition to the danger of deforming the finished metal tube in the V-groove of the take-up reel, it is a disadvantage that this method cannot provide an accurate alignment of the lengthwise seam with respect to the laser beam. The focal point of the laser beam is oftentimes located above the lengthwise slot creating a large "focal spot" covering the lengthwise seam, which requires greater laser energy or leads to a lower production speed.

SUMMARY OF THE INVENTION

It is an object of the present invention to improve the current method so that long lengths, i.e. of more than 3000 m, of the tube can be produced without any welding defects.

In practicing the method of the invention, a metal band with band edges is fed off of a storage reel and shaped by a forming tool into a lengthwise slotted tube with the band edges adjacent each other. In a particularly advantageous manner, the tube passes through a unitary guide made up of inlet and outlet guide portions. The laser beam is directed to the seam to be welded through a cutout in the guide. The inlet portion of the guide encompasses 100% of the tube to be welded to keep the band edges in contact with each other, while the outlet guide downstream of the welding point area leaves the seam area open to provide a good cooling effect but confines the welded tube to keep the weld stress free during cooling.

The inlet guide portion through which the slotted tube passes precisely aligns the band edges with each other, thereby permitting a defect-free butt seam to be produced. The outlet guide portion keeps the band edges together even after welding, so that a particularly intensive cooling of the welded seam is not required thereby economizing on cooling gas, e.g., argon.

Beyond that, in a particularly simple manner the guide ensures that both the lateral alignment as well as the height alignment of the lengthwise seam are optimal with respect to the laser beam, e.g. its focal point, so that no readjustment of the laser beam position is required during the manufacture.

A clamping tool located downstream of the guide provides twist-free guidance of the welded tube after welding, since the clamping jaws tightly surround the tube.

Desirably, the lengthwise edges of the metal band are trimmed before the tube shaping operation so that "virgin" band edges are available for welding, thus preventing welding defects due to impurities. The trimming is advantageously done with motorized rotary shears. Since considerable pressure forces occur during trimming and tube formation, there is a concern that some metals, such as aluminum or stainless steel, would be pitted by the tools. To prevent this, the metal band is wetted with a liquid lubricant. The simplest way of achieving this wetting is to pass the metal band through two felt strips, which are constantly impregnated with the lubricant. The lubricant also prevents pitting of the metal tube in the guidance tool area. This is a critical feature that permits achieving the long production lengths.

Although the method is suitable for nearly all weldable metals, it particularly solves the problems that arise when stainless steel bands are welded.

The welding point area is flushed with a protective gas, preferably helium. In addition to the cooling effect, it also prevents color changes from taking place in the welded seam area.

The welded metal tube is advantageously reduced in diameter downstream of the first clamping tool, and the reduced diameter tube is then pulled by the jaws of a second clamping tool. The diameter of the tube may be reduced by about 15 to 18% with a single pass. This allows increasing the line speed with respect to the welding speed. Another advantage lies in that the size of the end product can be chosen with the widest independence from the size of the welded tube. Tubes of any desired diameter within a certain range can be produced by changing the tube reduction tool (drawing device) and the jaws of the second clamping tool. If a tube reduction tool is also placed between the outlet of the guide and the first clamping tool, the diameter can be reduced twice by 15 to 18%, i.e. the line speed can be considerably increased.

The method of the invention is particularly suitable for producing optical fiber cables. To that end, one or more optical fibers are introduced into the still open slotted tube before the welding point area. With such cables, it is advantageous to fill the metal tube with petroleum jelly to protect the optical fibers from moisture.

It is particularly advantageous to introduce the optical fibers into the metal tube by means of a thin tubelet, and the earliest point at which the optical fibers are released is downstream of the welding point area. This tubelet has the task of protecting the sensitive optical fibers from the heat radiated by the welded seam. This protection is particularly effective if the metal tube is filled with petroleum jelly through a gap formed by the tubelet and a second tubelet made of copper, which surrounds the first tubelet. The earliest point at which the petroleum jelly reaches the welded tube is the welding point area. It is useful if the first inner tubelet is also made of copper, and is longer than the outer tubelet. Its end is located between the first and the second clamping tool, whereas the end of the outer tubelet is located in the area of the first clamping tool. Both tubelets extend from outside of the slotted tube. The amount of petroleum jelly being introduced into the welded tube is pressure controlled to fill the empty space between the optical fibers and the inside wall of the welded tube. The flowing petroleum jelly dissipates heat, thereby protecting the optical fibers inside the tubelet.

The cross section of the second tubelet is deformed at least in the area below the welding point area, so that the first tubelet guiding the optical fibers is positioned to an area lying opposite the lengthwise seam of the slotted tube. This achieves the greatest possible distance between the welded seam and the optical fibers in the welding point area.

During manufacture, the outer copper tubelet, and with it the inner tubelet, can be shifted or adjusted lengthwise to a certain degree. This may be necessary if deposits have formed on some part of the copper tubelet.

In optical cables, it is necessary for the optical fibers to have a certain excess length inside the metal tube, in order to keep mechanical stresses away from the sensitive optical fibers when the metal tube expands. Such an excess length can be obtained if the metal tube containing the optical fibers and the petroleum jelly is wound at least one winding onto a take-up reel, and then is wound with a slight tension onto a storage reel, and if the metal tube is elastically expanded between 0.2 and 0.8% between a fixed point formed either by the first clamping tool, the tube reducing tool or the second clamping tool and the take-up reel, and the elastic expansion is discharged by the take-up reel.

The invention will be fully understood when reference is made to the following detailed description taken in conjunction with the accompany drawings.

DETAILED DESCRIPTION OF THE INVENTION

Figure 1:
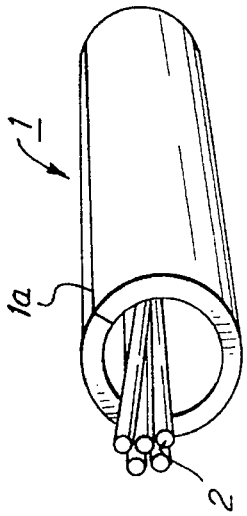
FIG. 1 is a perspective view of a tube manufactured in accordance with the principle of the invention.

FIG. 1 is a perspective view of part of a tube manufactured in accordance with the principle of the invention. Tube 1 contains a lengthwise welded seam 1*a*. A preferred application area for such lengthwise welded tubes 1 is the protective sheath of an optical cable. The inside of the tube 1 then contains one or more optical fibers 2. The open space between the optical fibers 2 and the metal tube 1 can be filled with petroleum jelly, to prevent the lengthwise migration of water. The number of optical fibers 2 is usually between six and twenty, even up to forty in exceptional cases. The optical fibers 2 are longer in length than the metal tube 1 so as to be helicoidal or sinusoidal inside the metal tube 1. The excess length is normally about 0.3%. The wall thickness of the metal tube 1 is about 0.2 mm, while its outside diameter is 3.5 mm. This is typical data for an optical cable used instead of a wire in a stranded conductor. Alloyed special steel is the preferred material for metal tube 1.

Figure 2:
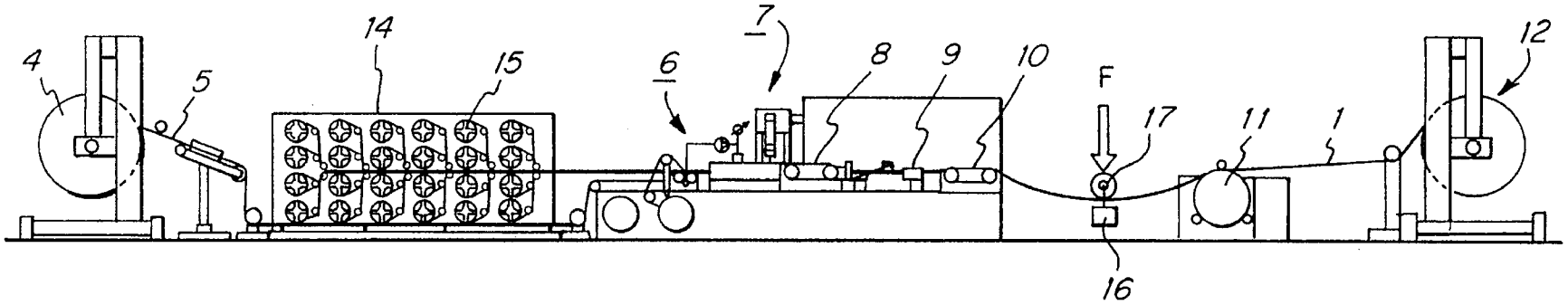
FIG. 2 is a side elevational view of a device for carrying out the method of the invention.
Figure 3:
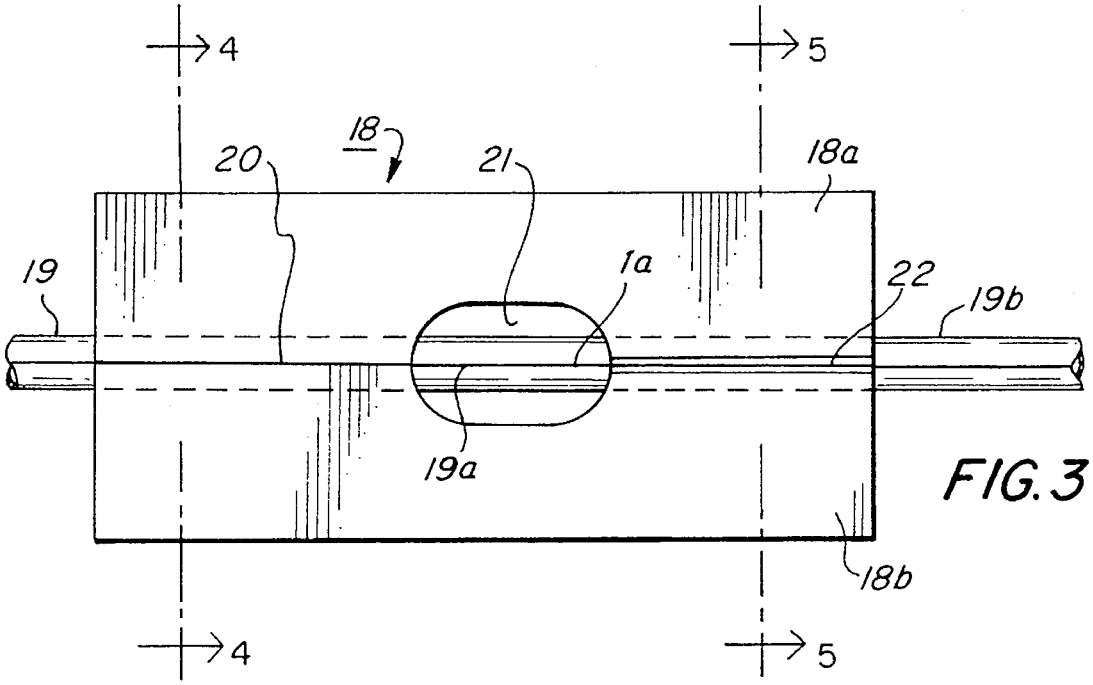
FIG. 3 is a top view of the tube guide located in the welding point area.
Figure 6:
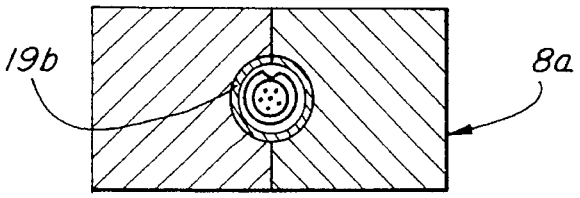
FIG. 6 is a cross-sectional view of a pair of clamping jaws of the clamping tool located downstream of the guide of FIG. 3.

Turning now to FIG. 2, therein is illustrated a device for carrying out the method of the invention. A metal band 5 is continuously drawn from a supply reel 4 and fed to a forming tool 6, in which the band 5 is shaped into a lengthwise slotted tube 19 (FIG. 3). Part of this forming tool 6 is a trimming device (not shown in detail), in which the band 5 is cut to the exact required width. The forming tool 6 further contains several sets of shaping rollers (not shown in detail). The lengthwise slot 19*a* (FIG. 3) of the slotted tube 19 is closed by a laser welding installation 7 which forms the lengthwise welded seam 1*a* (FIG. 1) in a semi-finished welded tube 19*b* (FIG. 3). A first clamping tool 8, comprising a number of clamping jaw sets 8*a* (one set shown in FIG. 6), which surround and tightly grip the tube 19*b* and are driven by an endless chain (not shown), precisely guides the slotted tube 19*a* a under the welding installation 7. A tube reducing tool 9, e.g. a drawing device that reduces the diameter of the tube, is located downstream of the first clamping tool 8. A second clamping tool 10, which grips the drawn tube and pulls it through the drawing device, is located downstream of the tube reducing tool 9. The drawing speed of the second clamping tool 10 is adjusted with respect to the drawing speed of the first clamping tool 8 as a function of the tube passage through the drawing device and the first clamping tool 8. The finished tube 1 can then be wound onto a storage reel 12.

However, if the tube is to be used as a protective sheath for optical fibers, it is necessary for a driven take-up reel 11 to be located downstream of the second clamping tool 10, and the tube is wound several times around its periphery. The take-up reel 11 is driven at a slightly faster speed than the speed of the second clamping tool 10. The take-up reel 12 winds the tube 1 with a slight tension.

A supply device 14 for a number of optical fibers 2 is located between the supply reel 4, and the forming tool 6. The supply device 14 is equipped with a number of spools 15, on which the optical fibers 2 are wound.

Figure 4:
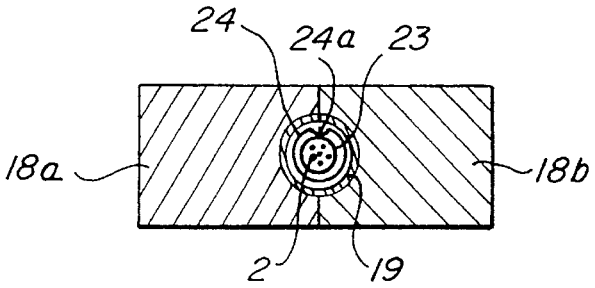
FIG. 4 is a cross-sectional view taken along the 4—4 line of FIG. 3.
Figure 5:
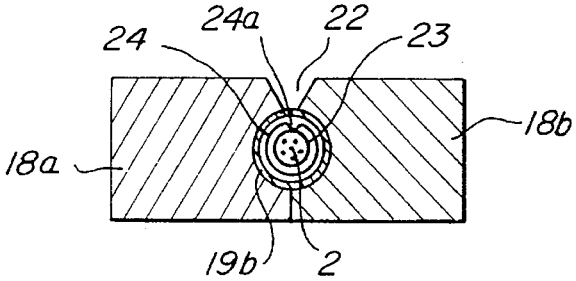
FIG. 5 is a cross-sectional view taken along 5—5 line of FIG. 3.

The optical fibers 2 are drawn from the spools 15 and guided into the slotted tube 19 (FIG. 3) in front of the welding installation 7. To protect the sensitive optical fibers 2, a fixed metal tubelet 23 (FIGS. 4 and 5) protrudes into the slotted tube 19, and the optical fibers 2 are guided through its inside. The earliest point at which the metal tubelet 23 releases the optical fibers 2 is downstream of the welding installation 7. The metal tubelet 23 is surrounded by another metal tubelet 24 (FIGS. 4 and 5). The gap formed by the two metal tubelets 23, 24 is filled with petroleum jelly under pressure. To ensure that the optical fibers 2 have excess length inside the metal tube 1, the metal tube 1 is continuously and elastically deformed, i.e. expanded lengthwise, between the second clamping tool 10, whose pairs of jaws tightly grip the metal tube 1 and produce deformation forces, and the take-up reel 11. In this way, the same length of metal tube 1 and optical fibers 2 is wound onto the take-up reel 11.

The elastically deformed condition "relaxes" on the take-up reel 11, the metal tube 1 shortens to its normal condition, resulting in the excess length of the optical fibers 2 with respect to the shrunk-back metal tube 1.

The elastic deformation is caused by force F, which deflects the metal tube 1 between the second clamping tool 10 and the take-up reel 11. This is achieved with a weight 16, which hangs on the metal tube 1, e.g. through a roller 17. The force F, i.e. weight 16, determines the magnitude of the deflection and thereby the magnitude of the expansion.

An accurate excess length of optical fibers 2 in tube 1 can be produced with a specified geometry and selection of the material for the metal tube 1.

In FIGS. 3 to 5, a guide 18 for the metal tube 1 in the area of the welding installation 7 includes first and second halves 18*a* and 18*b*, each of which has a groove 20 in its adjoining surface, with a radius that corresponds to the radius of metal tube 19. The two grooves 20 thus form an essentially circular guide path for the slotted metal tube 19.

One of the two halves 18*a* or 18*b* remains stationary, while the other half is adjustable or spring-biased, so that the pressure on the slotted tube 19 can be varied. The guide 18 is made of a steel alloy (preferably stainless steel), which has outstanding antifriction properties. The guide 18 contains a cutout 21 through which the laser beam of the laser welding installation 7 is directed onto the lengthwise seam 19*a* of the slotted metal tube 19 for the welding thereby creating a semi-finished welded metal tube 19*b*. Next to the cutout 21 is a gap 22 between the halves 18*a* and 18*b*, which exposes the welded seam 1*a* for heat dissipation.

Referring in detail to FIGS. 4 and 5, the tubelet 23 for the optical fibers 2 and the tubelet 24 for the petroleum jelly are shown inside the metal tube 19. Tubelet 24 is equipped with an indentation 24*a*, which spaces tubelet 23 from the lengthwise seam 19*a* or the welded seam 19. Both tubelets 23 and 24 are thin-walled copper tubelets, which protect the petroleum jelly as well as the optical fibers from excessive heat in the welding area. The tubelets 23 and 24 are adjustable lengthwise inside the slotted metal tube 19 and the semi-finished welded metal tube 19*b*.

The preferred embodiment described above admirably achieves the objects of the invention. However, it will be appreciated that departures can be made by those skilled in the art without departing from the spirit and scope of the invention which is limited only by the following claims.

What is claimed is:

1. A method for producing a lengthwise welded metal tube with an outside diameter of 1 to 6 mm, comprising the steps of:

(a) drawing a metal band from a storage reel, the metal band having band edges;

(b) using a forming tool to continuously shape the metal band into a lengthwise slotted tube with the band edges adjacent each other;

(c) guiding the lengthwise slotted tube through an inlet guide that contacts a surface of the lengthwise slotted tube whereby the band edges are kept in contact with each other;

(d) welding the band edges in a welding point area using a laser beam of laser welding device to form a welded tube having a welded seam;

(e) guiding the welded tube through an outlet guide that contacts a surface of the welded tube thereby keeping the welded seam stress-free; and (f) gripping the welded tube downstream of the weld point area with a clamping tool so the welded tube is guided and kept from twisting.

2. A method as claimed in claim 1, wherein the inlet and outlet guides form a unitary guide and the laser beam of the laser welding device is directed onto the band edges to be welded through a cutout in the unitary guide at the welding point area.

3. A method as claimed in claim 1, further including the step of trimming the metal band to create the band edges before the metal band is formed into the lengthwise slotted tube.

4. A method as claimed in claim 3, further including the step of wetting the metal band with a liquid lubricant prior to the trimming step.

5. A method as claimed in claim 1, wherein the metal band is a band of stainless steel.

6. A method as claimed in claim 1, wherein the welding point area is flushed with a protective gas.

7. A method as claimed in claim 1, further including the steps of reducing the diameter of the welded tube and pulling the tube with the reduced diameter using a second clamping tool.

8. A method as claimed in claim 1, further including the step of inserting at least one optical fiber into the slotted tube before the welding point area.

9. A method as claimed in claim 8, further including the step of filling the welded tube with petroleum jelly.

10. A method as claimed in claim 9, further comprising the step of elastically expanding the welded tube containing the optical fibers and petroleum jelly between 0.2 and 0.8% and releasing the elastic expansion so that the optical fibers have a precise excess length with respect to the welded tube.

11. A method as claimed in claim 8, wherein the optical fibers are inserted into the slotted tube by means of a first tubelet and the optical fibers are released from the first tubelet downstream of the welding point area.

12. A method as claimed in claim 11, further including the step of filling the welded tube with petroleum jelly through a gap formed between the first tubelet and a second tubelet surrounding the first tubelet, the petroleum jelly being released into the welded tube downstream of the welding point area.

13. A method as claimed in claim 12, wherein the welded tube is filled with an amount of petroleum jelly under pressure that is sufficient to completely fill the empty space between the optical fibers and the welded tube.

14. A method as claimed in claim 12, wherein at least in the welding point area, the second tubelet is deformed to position the first tubelet to an area of the second tubelet lying opposite the band edges.

15. A method as claimed in claim 12, wherein the tubelets are adjustably positioned within the welded tube.

16. A method as claimed in claim 1, further comprising the step of winding the welded tube onto a storage reel.

* * * * *